US008655207B2

(12) United States Patent
Kato et al.

(10) Patent No.: US 8,655,207 B2
(45) Date of Patent: Feb. 18, 2014

(54) IMAGE FORMING APPARATUS

(75) Inventors: Shuichi Kato, Nagoya (JP); Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 191 days.

(21) Appl. No.: 13/362,626

(22) Filed: Jan. 31, 2012

(65) Prior Publication Data

US 2012/0201551 A1 Aug. 9, 2012

(30) Foreign Application Priority Data

Feb. 3, 2011 (JP) ..... 2011-021518

(51) Int. Cl.
*G03G 15/00* (2006.01)

(52) U.S. Cl.
USPC ..... 399/44; 399/55

(58) Field of Classification Search
USPC ..... 399/44, 53, 55
See application file for complete search history.

(56) References Cited

U.S. PATENT DOCUMENTS

| | | | | |
|---|---|---|---|---|
| 7,555,232 | B2 * | 6/2009 | Imura | 399/55 |
| 7,907,855 | B2 * | 3/2011 | Akita | 399/44 |
| 2007/0086805 | A1 | 4/2007 | Matsushita et al. | |

FOREIGN PATENT DOCUMENTS

| | | | |
|---|---|---|---|
| JP | 2007-093950 | A | 4/2007 |
| JP | 2007-164032 | A | 6/2007 |

* cited by examiner

*Primary Examiner* — Hoang Ngo
(74) *Attorney, Agent, or Firm* — Baker Botts L.L.P.

(57) ABSTRACT

An image forming apparatus is provided. The image forming apparatus includes a photosensitive member, a developing roller which carries developer and contacts the photosensitive member, and a control device which is configured to apply, to the developing roller, a developing bias having a direct current component and an alternating current component overlapped with each other so as to supply developer from the developing roller to the photosensitive member. The control device is configured to execute either one of a first mode in which an amplitude of the alternating current component of the developing bias is set with a first set value and a second mode in which the amplitude of the alternating current component of the developing bias is set with a second set value larger than the first set value, based on whether or not a temperature of the developing roller is a first predetermined value or larger.

15 Claims, 7 Drawing Sheets

IMAGE FORMING APPARATUS

CROSS-REFERENCE TO RELATED APPLICATION

This application claims priority from Japanese Patent Application No. 2011-021518, filed on Feb. 3, 2011, the entire subject matter of which is incorporated herein by reference.

TECHNICAL FIELD

Aspects of the present invention relate to an image forming apparatus including a photosensitive member, on which an electrostatic latent image is formed and a developing roller which carries developer and contacts the photosensitive member to supply the developer to the photosensitive member.

BACKGROUND

There has been known an image forming apparatus including a photosensitive drum, on which an electrostatic latent image is formed and a developing roller which contacts the photosensitive drum to supply developer to the photosensitive drum (for example, refer to JP2007-93950A). In this technique, generally, a direct current voltage is applied to the developing roller, so that developer is moved from the developing roller to the photosensitive drum.

However, according to the above technique, when a temperature of the developing roller is lowered, for example, the developing roller becomes hard, so that a following capability of the developing roller with respect to the photosensitive drum is deteriorated and side end portions of the developing roller may be thus partially separated from the photosensitive drum. In this case, developer carried on side end portions of the developing roller are difficult to move to the separated photosensitive drum, so that a side end portion of a sheet is partially not printed (hereinafter, such problem is referred to as 'white out in a sheet side end portion').

SUMMARY

Accordingly, it is an aspect of the present invention to provide an image forming apparatus capable of suppressing a white out of a sheet (recording sheet) side end portion.

According to an illustrative embodiment of the present invention, there is provided an image forming apparatus comprising: a photosensitive member, on which an electrostatic latent image is to be formed; a developing roller which is configured to carry developer and contact the photosensitive member; and a control device which is configured to apply, to the developing roller, a developing bias having a direct current component and an alternating current component overlapped with each other so as to supply developer from the developing roller to the photosensitive member. The control device is configured to execute either one of a first mode in which an amplitude of the alternating current component of the developing bias is set with a first set value and a second mode in which the amplitude of the alternating current component of the developing bias is set with a second set value larger than the first set value, based on whether or not a temperature of the developing roller is a first predetermined value or larger.

According to the above configuration, when the temperature of the developing roller is smaller than the first predetermined value, the amplitude of the alternating current component of the developing bias is set with the second set value larger than the first set value. Therefore, even when side end portions of the developing roller are partially separated from the photosensitive drum under low-temperature circumstances in which the temperature is lower than the first set value, the toner can be blown off and moved to the photosensitive drum which is separated from both end portions of the developing roller, with a known jumping phenomenon method by the developing bias having the alternating current component having the high amplitude. Here, the jumping phenomenon method is a developing method that is performed in a configuration where the developing roller and the photosensitive member do not contact each other. According to this method, the alternating current voltage is applied to the developing roller, so that the developer can be blown off and moved to the photosensitive member separated from the developing roller.

According to another illustrative embodiment of the present invention, there is provided an image forming apparatus comprising: a photosensitive member, on which an electrostatic latent image is to be formed; a developing roller which is configured to carry developer and contact the photosensitive member; a fixing device which is configured to heat-fixes a developer image transferred onto a recording sheet; and a control device which is configured to apply, to the developing roller, a developing bias having a direct current component and an alternating current component overlapped with each other so as to supply developer from the developing roller to the photosensitive member. The control device is configured to switch between a first mode in which an amplitude of the alternating current component of the developing bias is set with a first set value and a second mode in which the amplitude of the alternating current component of the developing bias is set with a second set value larger than the first set value. The control device is configured to execute the second mode on a condition where a control mode of a heat source of the fixing device is switched from a mode in which the heat source is turned off to a printing mode.

According to the configuration, the second mode is executed when the mode is switched from the mode in which the heat source of the fixing device is turned off to the printing mode. Therefore, even when side end portions are separated from the photosensitive member during the printing operation since the heat source is off and thus the temperature of the developing roller is low, the developers can be blown off and moved to the photosensitive member.

According to the above configuration, it is possible to suppress a white out of a recording sheet side end portion.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

<Overall Configuration of Laser Printer>

Hereinafter, illustrative embodiments of the present invention will be specifically described with reference to the drawings. In the below descriptions, an overall configuration of a laser printer (an example of an image forming apparatus) is described first and then features specific to the illustrative embodiments are specifically described.

In the below descriptions, the directions are described on the basis of a user who uses the laser printer. That is, in FIG. 1, a left side of the sheet is referred to as the 'front side', a right side of the sheet is referred to as the 'rear side', an back side of the sheet is referred to as the 'left side' and a front side of the sheet is referred to as the 'right side.' Also, an upper-lower direction of the sheet is referred to as the 'upper-lower direction.'

Figure 1:
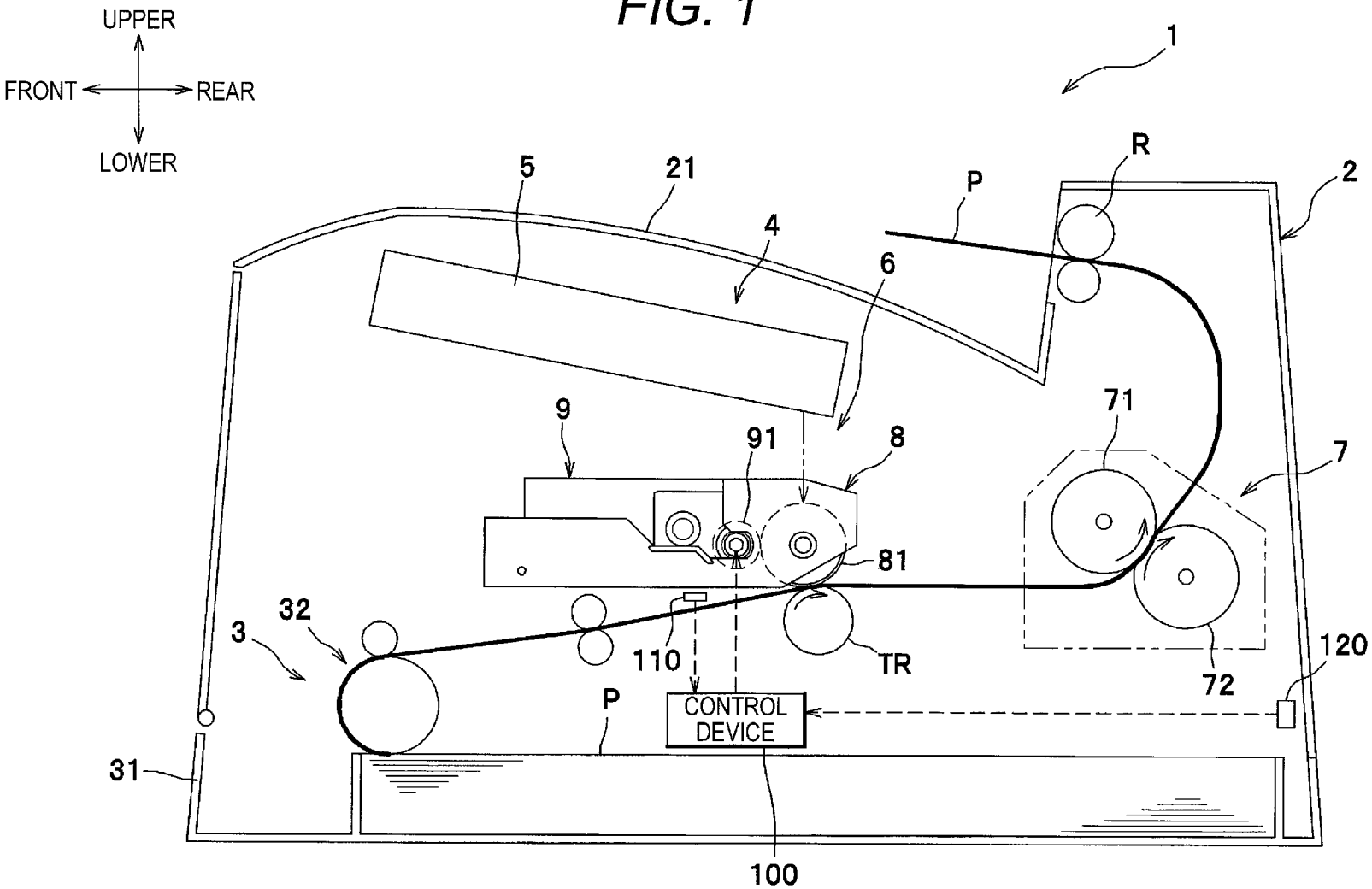
FIG. 1 is an explanatory view showing a laser printer according to a first illustrative embodiment of the present invention.

As shown in FIG. 1, a laser printer 1 includes a feeder unit 3 which feeds a sheet P into an apparatus main body 2 and an image forming unit 4 which forms an image on the sheet P.

The feeder unit 3 includes a sheet feeding tray 31 which is detachably mounted to a lower part of the apparatus main body 2 and a sheet feeding mechanism 32 which feeds the sheet P in the sheet feeding tray 31 toward the image forming unit 4.

The image forming unit 4 includes a scanner unit 5, a process cartridge 6, a transfer roller TR and a fixing device 7.

The scanner unit 5 is provided at the upper part in the apparatus main body 2 and includes a laser light emitting unit, a polygon mirror, a lens, a reflector and the like, which are not shown. The scanner unit 5 scans a laser beam on a surface of a photosensitive drum 81 (an example of the photosensitive member) with high-speed scanning.

The process cartridge 6 includes a drum cartridge 8 which is detachably mounted to the apparatus main body 2 and has the photosensitive drum 81, and a developing cartridge 9 which has a developing roller 91 contacting the photosensitive drum 81 and contains toner (an example of developer). The developing cartridge 9 is detachably attached to the drum cartridge 8.

In the process cartridge 6, the surface of the photosensitive drum 81 being rotated is uniformly charged by a charger (not shown) and then exposed by the high-speed scanning of the laser beam from the scanner unit 5. Thereby, a potential of the exposed part is lowered, so that an electrostatic latent image based on image data is formed on the surface of the photosensitive drum 81.

Toner in the developing cartridge 9 is carried by the developing roller 91 and then the toner on the developing roller 91 is supplied to the electrostatic latent image of the photosensitive drum 81, so that a toner image is formed on the surface of the photosensitive drum 81. Specifically, a control device 100 applies a developing bias to the developing roller 91, so that the toner is supplied to the photosensitive drum 81 from the developing roller 91. The control of the developing bias will be specifically described later.

Thereafter, as the sheet P is conveyed between the photosensitive drum 81 and the transfer roller TR, the toner image carried on the surface of the photosensitive drum 81 is transferred onto the sheet P.

The fixing device 7 includes a heating roller 71 and a pressing roller 72 which is arranged to oppose the heating roller 71 and presses the heating roller 71. In the fixing device 7, the toner transferred onto the sheet P is heat-fixed while the sheet P passes between the heating roller 71 and the pressing roller 72.

In the meantime, the sheet P heat-fixed in the fixing device 7 is conveyed to sheet discharge rollers R provided downstream from the fixing device 7 and then sent onto a sheet discharge tray 21 from the sheet discharge rollers R.

<Control Device>

In the below, the control device 100 is specifically described.

The control device 100 includes a CPU, a RAM, a ROM and an input/output circuit, for example, and performs respective calculation processing, based on an input from a temperature sensor 110 or a humidity sensor 120, a content of a printing instruction and programs and data stored in the ROM, thereby executing the control.

The temperature sensor 110 is provided near the developing roller 91 and detects an air temperature around the developing roller 91. The humidity sensor 120 is provided near an introduction port (not shown) for introducing the outside air into the apparatus main body 2 and detects a humidity outside the apparatus main body 2.

Figure 2A:
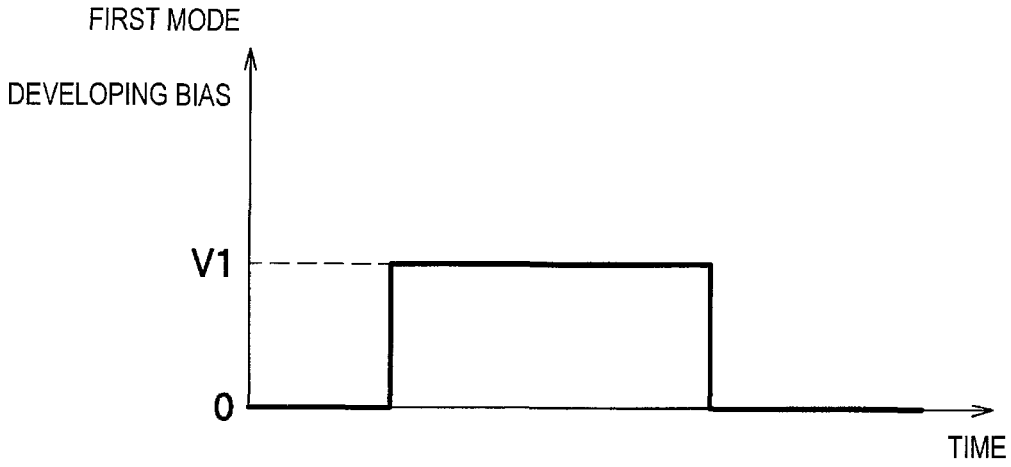
FIGS. 2A and 2B are graphs showing developing biases in respective modes according to the first illustrative embodiment.
Figure 2B:
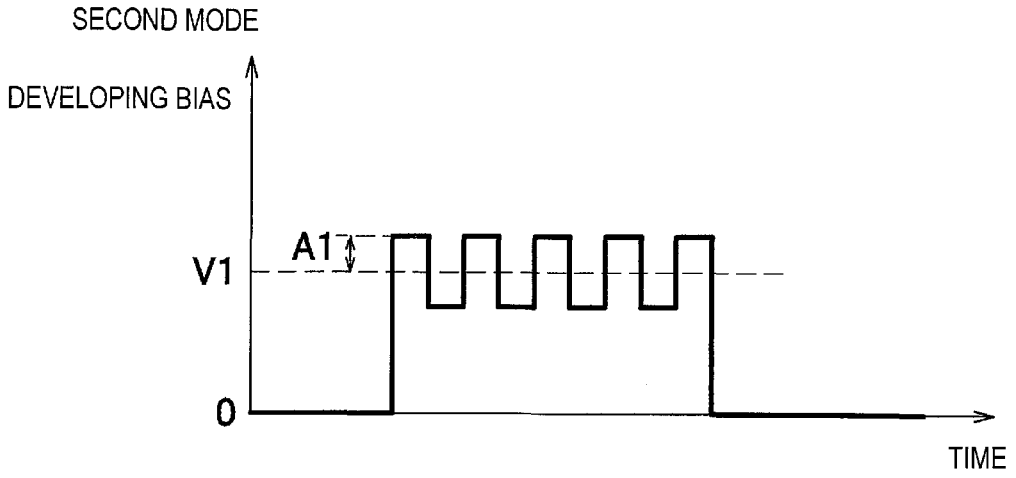

The control device 100 is configured to apply a developing bias having a direct current component and an alternating current component overlapped with each other to the developing roller 91 so as to supply toner from the developing roller 91 to the photosensitive drum 81. The control device 100 is configured to switch between a first mode (refer to FIG. 2A) of setting an amplitude of the alternating current component of the developing bias to be a first set value (zero) and a second mode (refer to FIG. 2B) of setting the amplitude of the alternating current component of the developing bias to be a second set value A1 larger than the first set value.

That is, in the first mode, the control device 100 applies, to the developing roller 91, the developing bias substantially configured by only the direct current component of a voltage V1 which is obtained by overlapping the alternating current component having an amplitude of zero with the direct current component of the voltage V1 which is a reference value. In the second mode, the control device 100 applies, to the developing roller 91, the developing bias having a direct current component and an alternating current component overlapped with each other, which is obtained by overlapping the alternating current component having an amplitude of A1 with the direct current component of the voltage V1 which is a reference value.

Figure 3A:
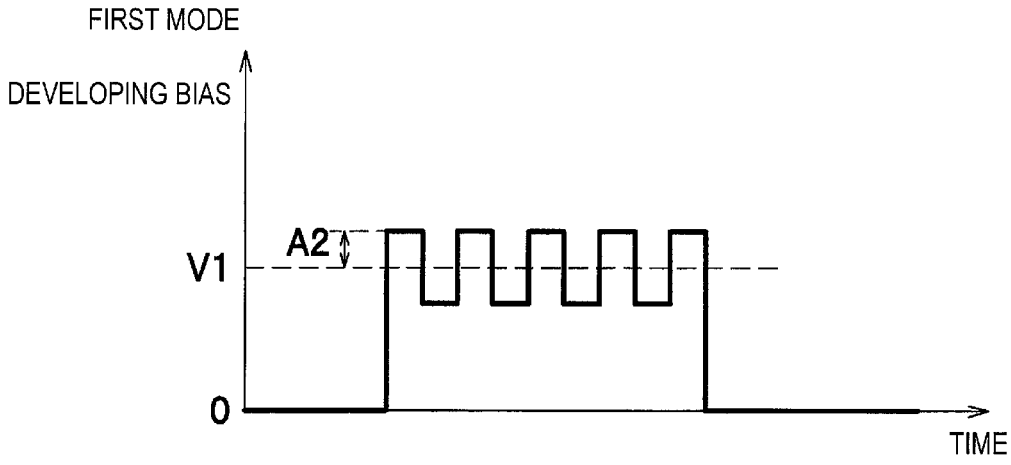
FIGS. 3A and 3B are graphs showing developing biases in respective modes according to modified illustrative embodiment.
Figure 3B:
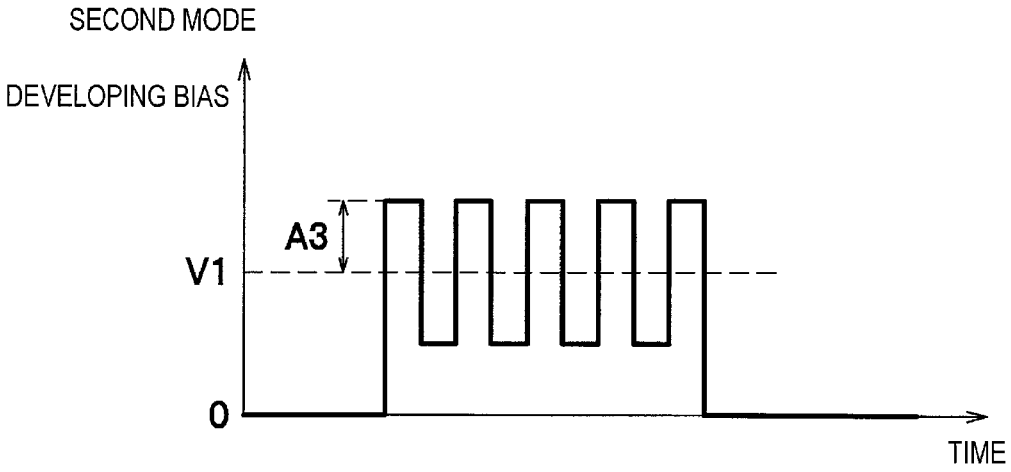

In this illustrative embodiment, the first set value is zero. However, the present invention is not limited thereto. For example, as shown in FIGS. 3A and 3B, a value smaller than a second set value A3 may be used as a first set value A2. Here, the first set value and the second set value may be appropriately determined by a test, a simulation or the like. For example, the fist set value may be set with such a small amplitude that the toner is not blown off from the developing roller 91 to the photosensitive drum 81 by a jumping phenomenon at a more forward or rearward side of a conveyance direction than a nip portion (contact portion) between the developing roller 91 and the photosensitive drum 81. The second set value may be set with such a large amplitude enough to suppress the white out of the sheet side end portion.

Figure 4:
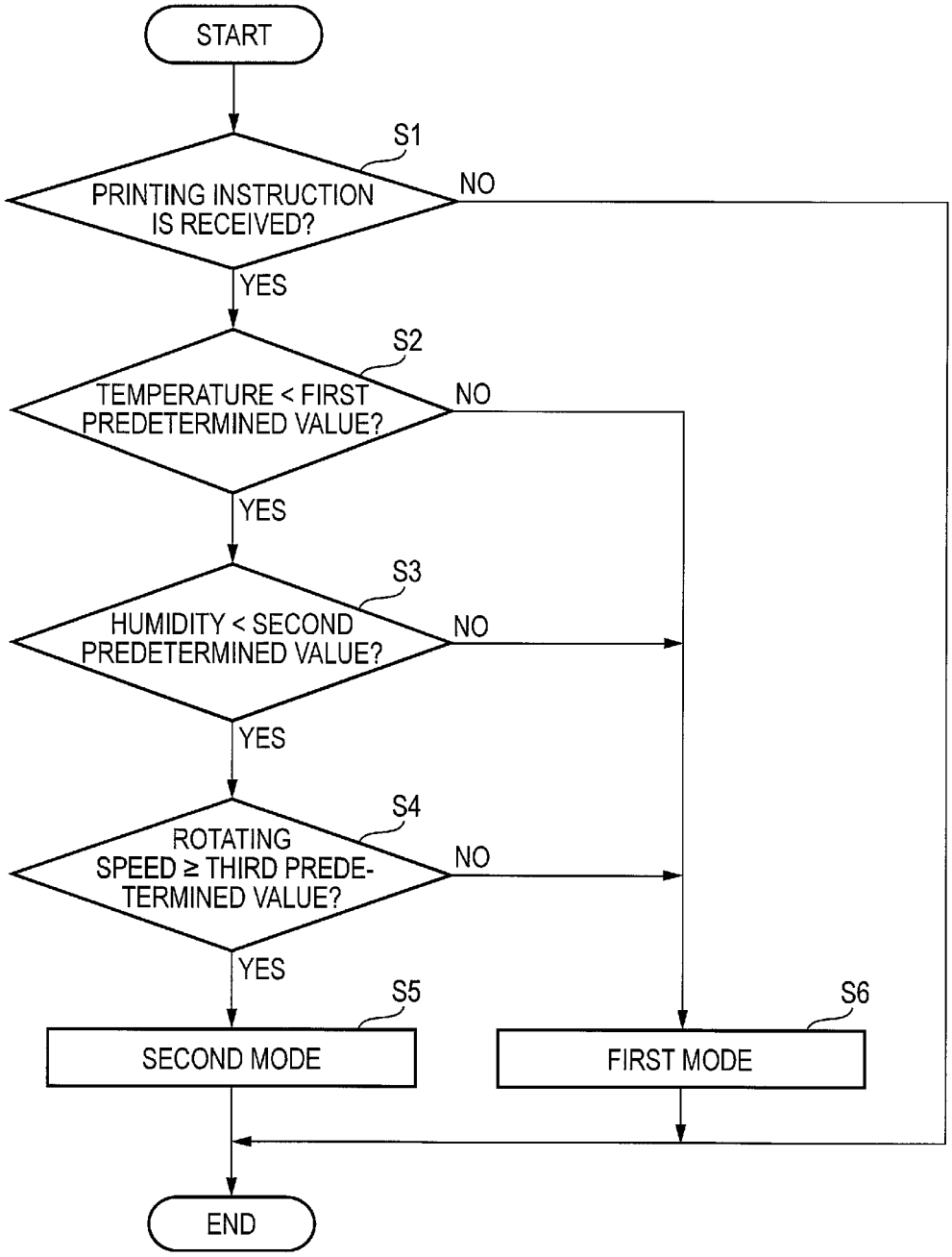
FIG. 4 is a flowchart showing an operation of a control device according to the first illustrative embodiment.

The control device 100 switches between the first mode and the second mode in accordance with a flowchart shown in FIG. 4.

As shown in FIG. 4, the control device 100 determines whether a printing instruction is received (S1). When it is determined in the step S1 that a printing instruction is not received (No), the control device 100 ends this control. When a printing instruction is received (Yes), the control device determines whether a temperature acquired from the temperature sensor 110 is lower than a first predetermined value (S2).

Here, the first predetermined value may be determined by a test, a simulation and the like. For example, the first predetermined value may be set with a temperature when there is a possibility that side end portions of the developing roller 81 will be partially separated from the photosensitive drum 81 during the printing operation.

When it is determined in the step S2 that the temperature is lower than the first predetermined value (Yes), the control device 100 determines whether a humidity acquired from the humidity sensor 120 is lower than a second predetermined value (S3). Here, the second predetermined value may be determined by a test, a simulation and the like. For example, the second predetermined value may be set with a humidity when there is a possibility that side end portions of the developing roller 81 will be partially separated from the photosensitive drum 81 during the printing operation.

When it is determined in the step S3 that the humidity is lower than the second predetermined value (Yes), the control device 100 determines whether rotating speed of the developing roller 91 is a third predetermined value or larger (S4). Here, the control device 100 may acquire the rotating speed of the rotating roller 91 from a rotating speed sensor (not shown) or may estimate the rotating speed based on a content of the printing instruction (for example, a normal sheet printing or cardboard printing).

In the meantime, the third predetermined value may be determined by a test, a simulation and the like. For example, the third predetermined value may be set with a rotating speed when the white out of the sheet side end portion occurs as the rotating speed is gradually increased.

When it is determined in the step S4 that the rotating speed of the developing roller 91 is the third predetermined value or larger, the control device 100 executes the second mode (S5). Specifically, in the step S5, the control device 100 executes the second mode until the printing control ends.

Meanwhile, in this illustrative embodiment, the second mode is executed until the printing control ends. However, the present invention is not limited thereto. For example, the second mode may be executed only for a predetermined time period and the remaining printing may be performed in the first mode after the predetermined time period elapses. Also, the second mode may be executed for the predetermined number of sheets (until the printing is completed for the predetermined number of sheets) and then the printing of the remaining number of sheets may be executed in the first mode. Alternatively, it may be possible to provide a sensor for detecting the number of revolutions of the developing roller 91, and the second mode is executed until the number of revolutions of the developing roller 91 reaches a predetermined value and then the remaining printing is performed in the first mode.

That is, by limiting the time period during which the second mode is executed, it is possible to suppress the second mode from being unnecessarily executed and to thus suppress the power from being unnecessarily consumed. The predetermined time period, the predetermined number of sheets or predetermined number of revolutions may be appropriately set by a test, a simulation and the like. For example, while the printing is performed in the first mode under circumstances in which the white out of the sheet side end portion occurs, a time period (the number of sheets, the number of revolutions) from the printing start until the white out of the sheet side end portion does not occur may be set as the predetermined time period (the predetermined number of sheets, the predetermined number of revolutions).

Also, when it is determined in the step S2 that the temperature is the first predetermined value or larger (No), in the step S3 that the humidity is the second predetermined value or larger (No) or in the step S4 that the rotating speed is below the third predetermined value (No), the control device 100 executes the first mode (S6).

According to this illustrative embodiment as described above, following effects may be realized.

When the temperature of the developing roller 91 is lower than the first predetermined value, the control is switched into the second mode (S5) in which the amplitude of the alternating current component of the developing bias is set with the second set value larger than the first set value. Therefore, when side end portions of the developing roller 91 are partially separated from the photosensitive drum 81 under low-temperature circumstances where the temperature is lower than the first set value, the toner can be blown off and moved to the photosensitive drum 81, which is separated from side end portions of the developing roller 91, with a know jumping phenomenon method by the developing bias having the alternating current component with the high amplitude. Accordingly, it is possible to suppress the white out of the sheet side end portion under low-temperature circumstances.

In the above-described illustrative embodiment, the respective modes are selected while taking into consideration the humidity outside the apparatus main body 2 and the rotating speed of the developing roller 91 as well as the temperature condition. Therefore, it is possible to estimate the situations where the white out of the sheet side end portion occurs more appropriately by considering conditions other than the temperature. As a result, it is possible to suppress the power from being unnecessary consumed, which is caused by unnecessarily increasing the amplitude. Specifically, when the humidity is low, the developing roller 91 becomes hard due to the dryness, so that the end portions of the developing roller 91 tend to be partially separated from the photosensitive drum during the printing operation. However, it is possible to suppress the white out of the sheet side end portion by considering the humidity condition. Also, when the rotating speed of the developing roller 91 is increased, the vibration due to shaking of a developing roller axis is increased, so that the end portions of the developing roller 91 tend to be partially separated from the photosensitive drum during the printing operation. However, it is possible to suppress the white out of the sheet side end portion by considering the rotating speed condition.

In the meantime, regarding the variation of the rotating speed of the developing roller 91, a following case may be exemplified. When printing a normal sheet, the control device 100 rotates the developing roller 91 at full speed (predetermined rotating speed) and when printing a cardboard, the control device rotates the developing roller 91 at a half speed (speed slower than the predetermined rotating speed).

The first set value is set with zero, so that the toner is supplied by the developing bias having only the direct current component in the first mode. Accordingly, in the first mode, it is possible to prevent the toner from being erroneously blown off at the front and rear of the nip portion between the developing roller 91 and the photosensitive drum 81.

Second Illustrative Embodiment

In the below, a second illustrative embodiment of the present invention is specifically described with reference to the drawings. In the meantime, since this illustrative embodiment is a partial modification to the first illustrative embodiment, the same constitutional elements as the first illustrative embodiment are indicated with the same reference numerals and the descriptions thereof are omitted.

Figure 5:
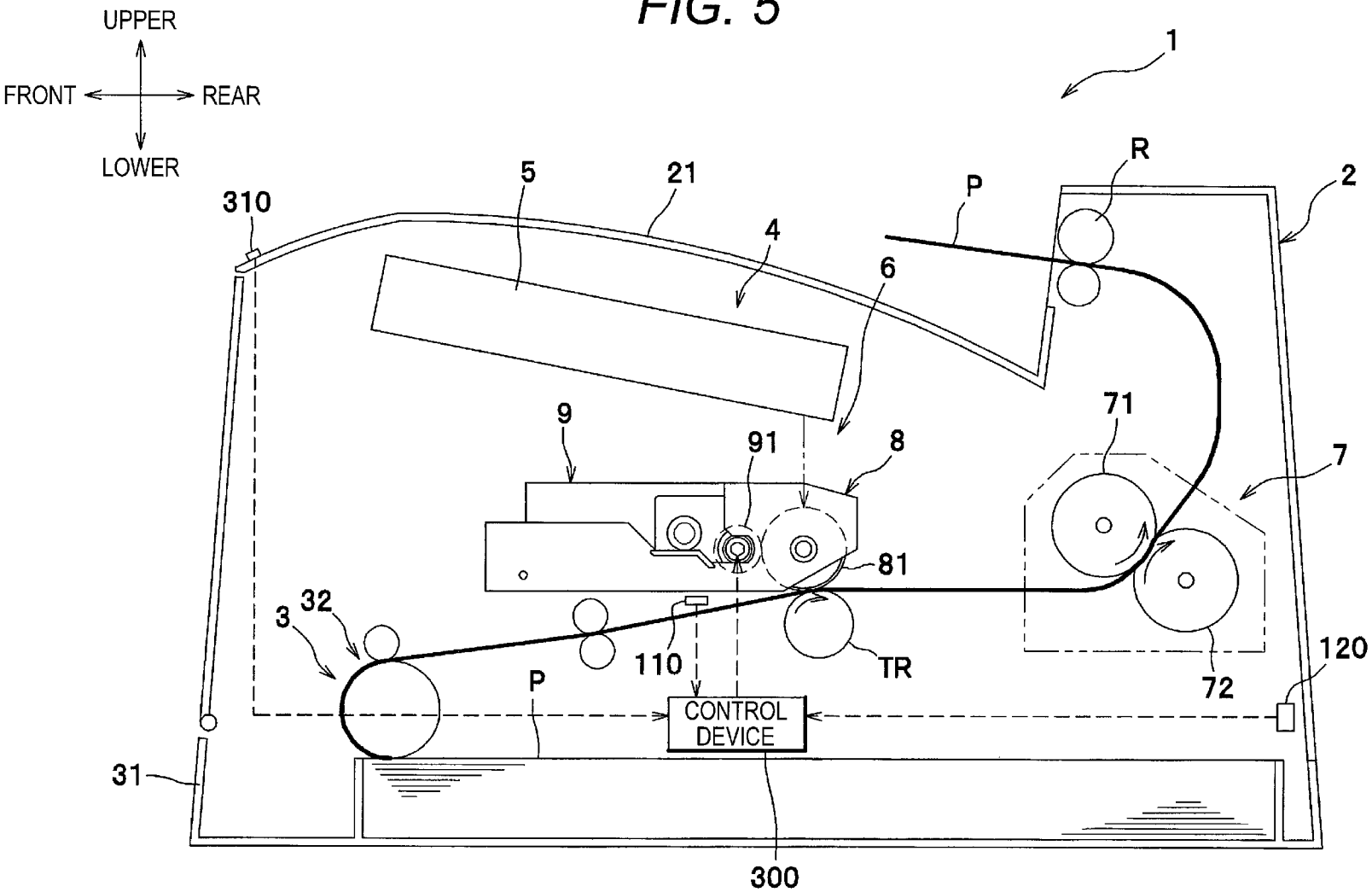
FIG. 5 is an explanatory view showing a laser printer according to a second illustrative embodiment.

As shown in FIG. 5, a control device 300 according to the second illustrative embodiment is configured to switch the respective modes, based on information from a selection switch 310 which is operated by a user, in addition to the respective conditions of the first illustrative embodiment. The selection switch 310 is provided at a proper location of the apparatus main body 2, for example at a front side of an upper surface of the apparatus main body 2.

The selection switch 310 is a switch which can be switched between a first position and a second position, and is configured to output an ON signal to the control device 300 when it is located at the second position and not to output an ON signal to the control device 300 when it is located at the first position. Before determining the above-described conditions (S2 to S4), the control device 300 determines whether a signal input from the selection switch 310 is an ON signal. When the ON signal is received (when the selection switch is located at the second position), the control device 300 executes the second mode in accordance with the conditions, and when the ON signal is not received (when the selection switch 310 is located at the first position), the control device executes only the first mode.

In other words, the selection switch 310 is switched between the first position and the second position, thereby switching a status (state) of the laser printer 1 between a first state (OFF state of the selection switch 310) and a second state (ON state of the selection switch 310). Also, the control device 300 is configured to execute the first mode on a condition where the status is the first state and to execute the second mode on a condition where the status is the second state.

In this illustrative embodiment, when the selection switch 310 is located at the second position, the ON signal is output from the selection switch 310. However, the present invention is not limited thereto. For example, in contrast to the configuration, when the selection switch 310 is located at the first position, the ON signal may be output from the selection switch 310.

Figure 6:
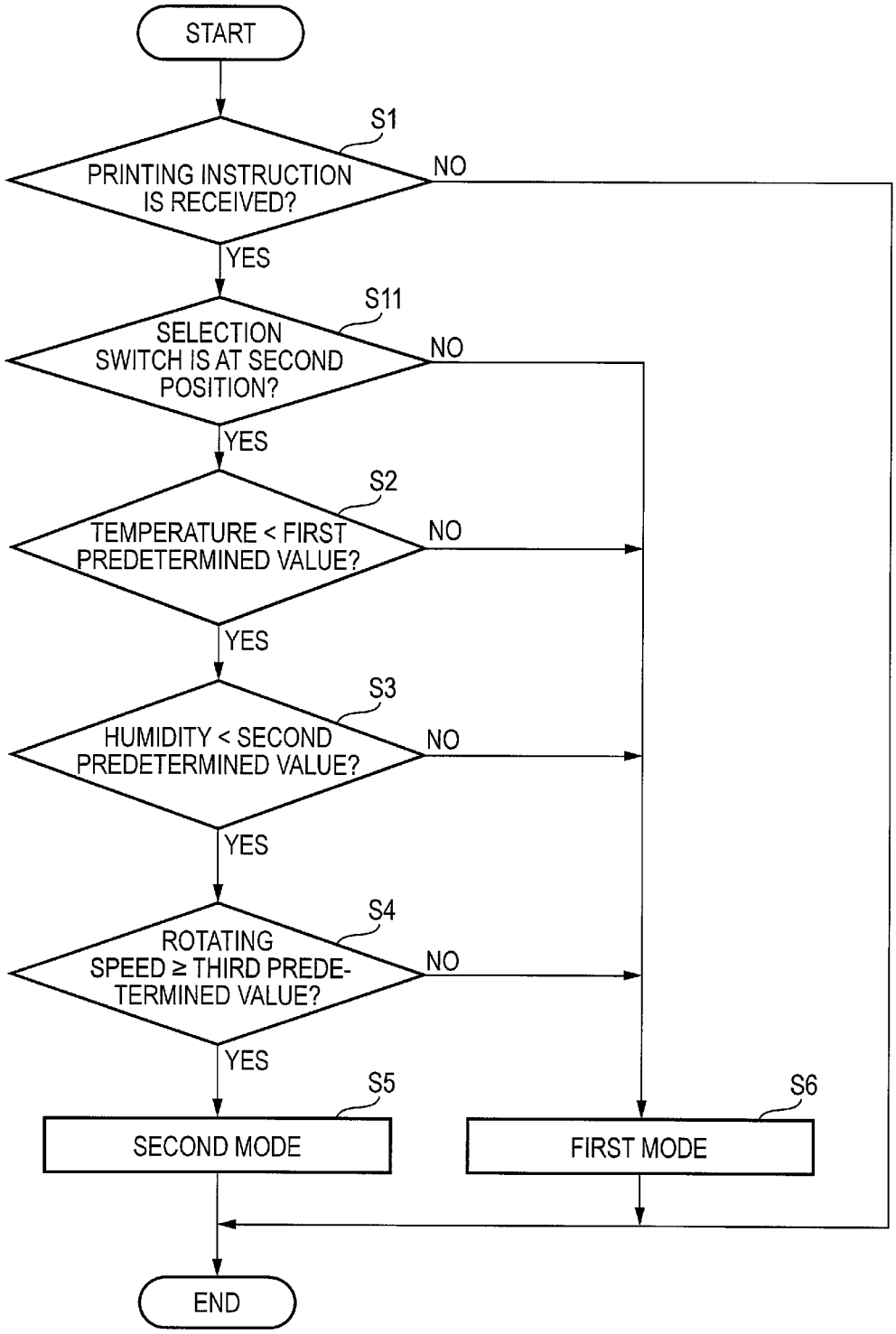
FIG. 6 is a flowchart showing an operation of a control device according to the second illustrative embodiment.

The control device 300 switches the respective modes based on a flowchart shown in FIG. 6. Here, the flowchart shown in FIG. 6 is different from the flowchart (FIG. 4) of the first illustrative embodiment, in that a new step S11 is added between the step S1 and the step S2.

In a step S11, the control device 300 determines whether the ON signal is output from the selection switch 310, i.e., whether the selection switch 310 is located at the second position (whether the selection switch is located at the first position or second position). When the selection switch 310 is located at the second position (Yes), the control device 300 proceeds to the step S2, and when the selection switch 310 is located at the first position (No), the control device executes the first mode which is a normal mode.

According to this illustrative embodiment, when the laser printer 1 is used under circumstances where the white out of the sheet side end portion is less likely to occur, the user switches the selection switch 310 into the first position, so that it is possible to execute the first mode which is a normal mode without executing the plurality of processing (steps S2 to S4).

Third Illustrative Embodiment

In the below, a third illustrative embodiment of the present invention is specifically described with reference to the drawings. In the meantime, since this illustrative embodiment is a modification to the control of the control device 100 according to the first illustrative embodiment, the same constitutional elements as the first illustrative embodiment are indicated with the same reference numerals and the descriptions thereof are omitted.

Figure 7:
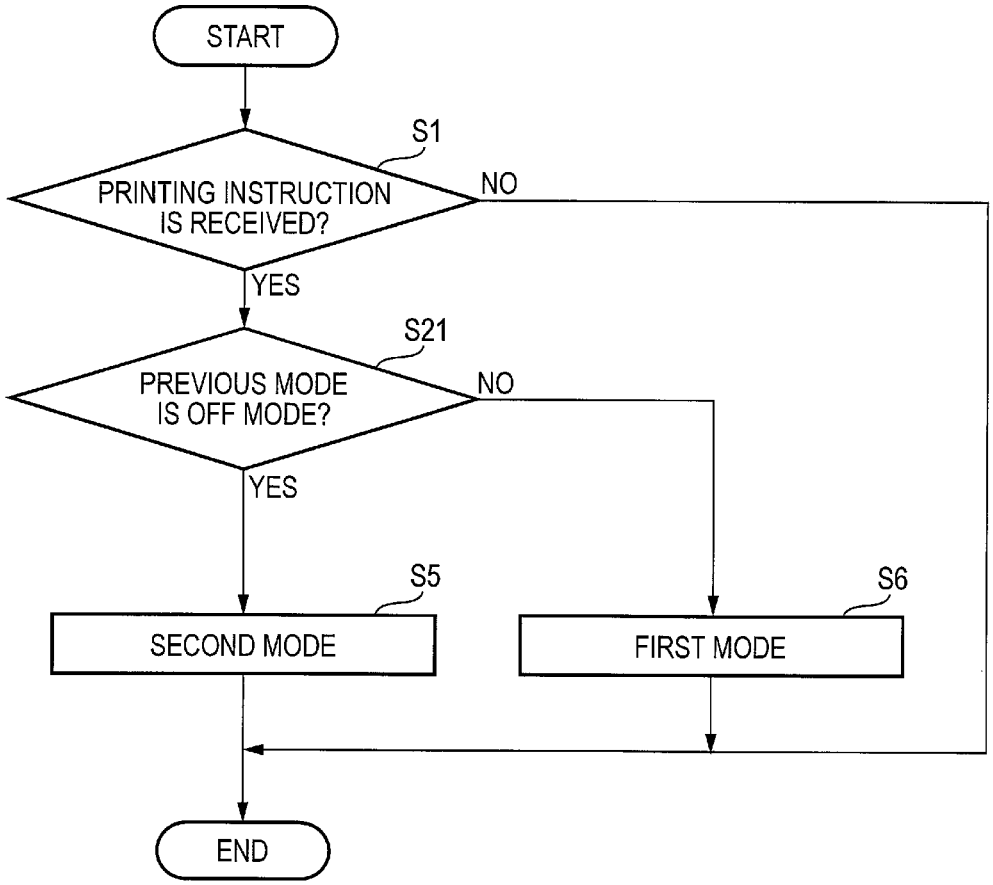
FIG. 7 is a flowchart showing an operation of a control device according to a third illustrative embodiment of the present invention.

As shown in FIG. 7, a control device according to the third illustrative embodiment is configured to execute the second mode when a control mode of a heat source of the fixing device 7 is switched from an OFF mode (a mode in which the heat source is OFF) to a printing mode (a mode in which the temperature of the heating roller 71 is increased to a predetermined fixing temperature by the heat source and the heating roller is thus kept at the fixing temperature). Here, as the OFF mode, a mode in which the heat source becomes OFF as a power supply of the laser printer 1 is cut off, a sleep mode (a mode in which the heat source becomes OFF as the laser printer 1 is not used for a long time) and the like may be exemplified. Also, as the mode that is not the OFF mode, a ready mode in which the heat source is made to stand by at a ready temperature lower than the fixing temperature may be exemplified in addition to the above-described printing mode.

Specifically, the control device determines whether a printing instruction is received (S1). When it is determined in the step S1 that the printing instruction is not received (No), the control device ends this control, and when the printing instruction is received (Yes), the control device determines whether the previous control mode of the heat source is the OFF mode (S21).

When it is determined in the step S21 that the previous control mode of the heat source is the OFF mode (Yes), the control device executes the second mode (S5), and when the previous control mode is not the OFF mode (No), the control device executes the first mode (S6).

According to this illustrative embodiment, when the previous control mode of the heat source is the OFF mode, the temperature of the developing roller 91 would be low, so that there is a possibility that the white out of the sheet side end portion will occur. Hence, in this case, the second mode is executed to suppress the white out of the sheet side end portion.

While the present invention has been shown and described with reference to certain illustrative embodiments thereof, it will be understood by those skilled in the art that various changes in form and details may be made therein without departing from the spirit and scope of the invention as defined by the appended claims.

In the first illustrative embodiment, the respective conditions of the temperature, the humidity and the rotating speed are used as the conditions for switching the respective modes. However, the present invention is not limited thereto. For example, the respective modes may be switched based on only at least the temperature condition.

In the above respective illustrative embodiments, the photosensitive drum 81 is employed as a photosensitive member. However, the present invention is not limited thereto. For example, a belt-type photosensitive member may be employed.

In the above illustrative embodiments, the laser printer 1 is illustrated as an example of an image forming apparatus. However, the present invention is not limited thereto. For example, the inventive concept of the present invention may be applied to other image forming apparatuses, for example a copier, a complex machine and the like.

In the above illustrative embodiments, the sheet P such as cardboard, postcard, thin sheet and the like is used as an example of a recording sheet. However, the present invention is not limited thereto. For example, an OHP sheet may be used.

In the above illustrative embodiments, the selection switch 310 which can be switched between the first position and the second position is employed. However, the present invention is not limited thereto. For example, a selection switch whose position is not changed (although the position of the selection switch is the same, a flag is switched in a memory of the image forming apparatus) such as touch panel may be adopted. Also in this case, since the status of the image forming apparatus is switched between the first state (for example, ON state) and the second state (for example, OFF state) as the user operates the selection switch, the control device can appropriately switch the first mode and second mode depending on the status of the image forming apparatus.

What is claimed is:

1. An image forming apparatus comprising:

a photosensitive member, on which an electrostatic latent image is to be formed;

a developing roller which is configured to carry developer and contact the photosensitive member; and a control device which is configured to apply, to the developing roller, a developing bias having a direct current component and an alternating current component overlapped with each other so as to supply developer from the developing roller to the photosensitive member, wherein the control device is configured to execute either one of a first mode in which an amplitude of the alternating current component of the developing bias is set with a first set value and a second mode in which the amplitude of the alternating current component of the developing bias is set with a second set value larger than the first set value, based on whether or not a temperature of the developing roller is a first predetermined value or larger.

2. The image forming apparatus according to claim 1, wherein the control device is configured to execute:

the first mode on a condition where the temperature of the developing roller is the first predetermined value or larger, and the second mode on a condition where the temperature of the developing roller is smaller than the first predetermined value.

3. The image forming apparatus according to claim 1, wherein the control device is configured to execute either one of the first mode and the second mode further based on whether or not a humidity outside an apparatus main body of the image forming apparatus is a second predetermined value or larger.

4. The image forming apparatus according to claim 1, wherein the control device is configured to execute either one of the first mode and the second mode further based on whether or not a rotating speed of the developing roller is a third predetermined value or larger.

5. The image forming apparatus according to claim 1, further comprising:

a selection switch which is configured to switch a status of the image forming apparatus between a first state and a second state based on a user operation, wherein the control device is configured to determine whether the status is the first state or the second state before determining whether or not the temperature of the developing roller is a first predetermined value or larger, and to execute either one of the first mode and the second mode further based on whether the status is the first state or the second state.

6. The image forming apparatus according to claim 5, wherein the control device is configured to execute:

the first mode on a condition where it is determined that the status is the first state, and either one of the first mode and the second mode based on whether or not the temperature of the developing roller is the first predetermined value or larger on a condition where it is determined that the status is the second state.

7. The image forming apparatus according to claim 1, wherein the first set value is zero.

8. The image forming apparatus according to claim 1, wherein the control device is configured to execute the second mode until a predetermined time period has elapse after starting execution of the second mode.

9. The image forming apparatus according to claim 1, wherein the control device is configured to execute the second mode for printing a predetermined number of sheets.

10. The image forming apparatus according to claim 1, wherein the control device is configured to execute the second mode until the number of revolutions of the developing roller reaches a predetermined value.

11. An image forming apparatus comprising:

a photosensitive member, on which an electrostatic latent image is to be formed;

a developing roller which is configured to carry developer and contact the photosensitive member;

a fixing device which is configured to heat-fixes a developer image transferred onto a recording sheet; and a control device which is configured to apply, to the developing roller, a developing bias having a direct current component and an alternating current component overlapped with each other so as to supply developer from the developing roller to the photosensitive member, wherein the control device is configured to switch between a first mode in which an amplitude of the alternating current component of the developing bias is set with a first set value and a second mode in which the amplitude of the alternating current component of the developing bias is set with a second set value larger than the first set value, and wherein the control device is configured to execute the second mode on a condition where a control mode of a heat source of the fixing device is switched from a mode in which the heat source is turned off to a printing mode.

12. The image forming apparatus according to claim 11, wherein the first set value is zero.

13. The image forming apparatus according to claim 11, wherein the control device is configured to execute the second mode until a predetermined time period has elapse after starting execution of the second mode.

14. The image forming apparatus according to claim 11, wherein the control device is configured to execute the second mode for printing a predetermined number of sheets.

15. The image forming apparatus according to claim 11, wherein the control device is configured to execute the second mode until the number of revolutions of the developing roller reaches a predetermined value.

* * * * *